United States Patent [19]

Ridett

[11] Patent Number: 4,663,897

[45] Date of Patent: May 12, 1987

[54] BUILDINGS

[76] Inventor: Alan H. Ridett, Binfield House, Mill Lane, Binfield, Newport, Isle of Wight, England

[21] Appl. No.: 654,475

[22] Filed: Sep. 26, 1984

Related U.S. Application Data

[63] Continuation-in-part of Ser. No. 388,674, Jun. 15, 1982, abandoned.

[30] Foreign Application Priority Data

Jun. 20, 1981 [GB] United Kingdom ..... 8119095
Dec. 3, 1981 [GB] United Kingdom ..... 8136419

[51] Int. Cl.[4] ..... E04B 1/34; E04B 1/74

[52] U.S. Cl. ..... 52/73; 126/428; 126/432; 126/437; 165/48.2; 165/53

[58] Field of Search ..... 52/73, 82, 79.4, 236.1; D25/1, 3, 32; 126/417, 428, 431, 432, 437, 442, 446; 165/48.1, 48.2, 53, 54, 56, 57

[56] References Cited

U.S. PATENT DOCUMENTS

| | | | |
|---|---|---|---|
| D. 198,673 | 7/1964 | Strogilis | 52/73 X |
| D. 227,239 | 6/1973 | Wheeler | 52/73 X |
| D. 227,357 | 6/1973 | Wheeler | 52/73 X |
| 3,452,493 | 7/1969 | Mims | 52/73 |
| 3,600,865 | 8/1971 | Vanich | 52/73 |
| 3,633,325 | 1/1972 | Bartoli | 52/73 |
| 3,949,732 | 4/1976 | Reines | 126/432 X |
| 4,049,195 | 9/1977 | Rugenstein | 52/82 X |
| 4,253,446 | 3/1981 | Muller | 126/437 X |
| 4,307,708 | 12/1981 | Tatusmi | 126/437 X |
| 4,319,437 | 3/1982 | Murphy | 126/432 X |
| 4,350,200 | 9/1982 | McElwain | 126/428 X |
| 4,408,596 | 10/1983 | Worf | 126/428 |

*Primary Examiner*—Stanley N. Gilreath
*Attorney, Agent, or Firm*—Samuel Meerkreebs

[57] ABSTRACT

A building comprises hollow, load-bearing structure, the interior of the structure defining ducts, exterior panels carried by the structure in heat-conducting relationship with the panels, a heat sink, and a heat pump. Water is circulated through the interior of the hollow structure so as to extract solar and other ambient heat from the panels and to transfer this useful heat to the heat sink.

11 Claims, 38 Drawing Figures

56
57
55
52
55
54
46
55
59
59
53

72
76
67
61
77
62
62
60
64

FIG.14.
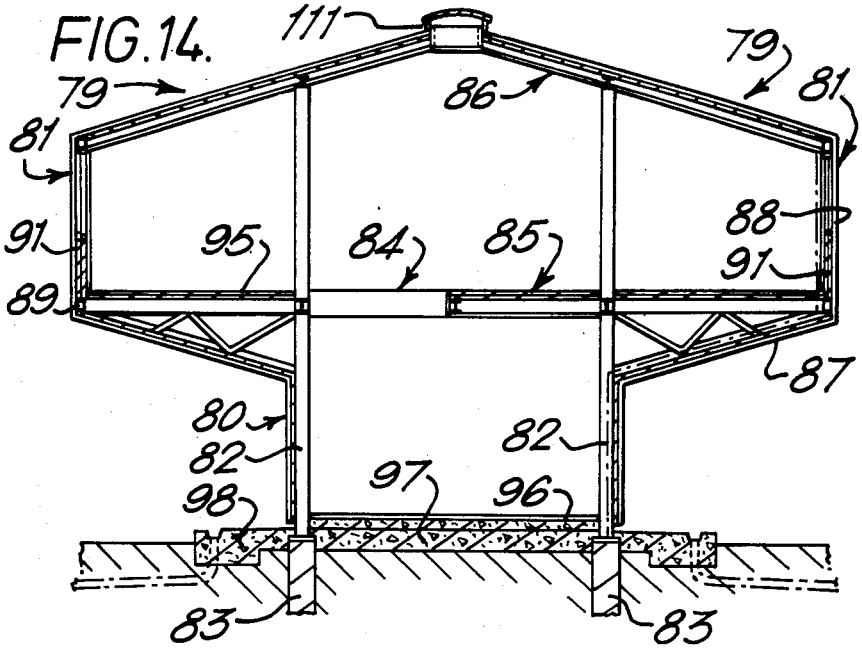
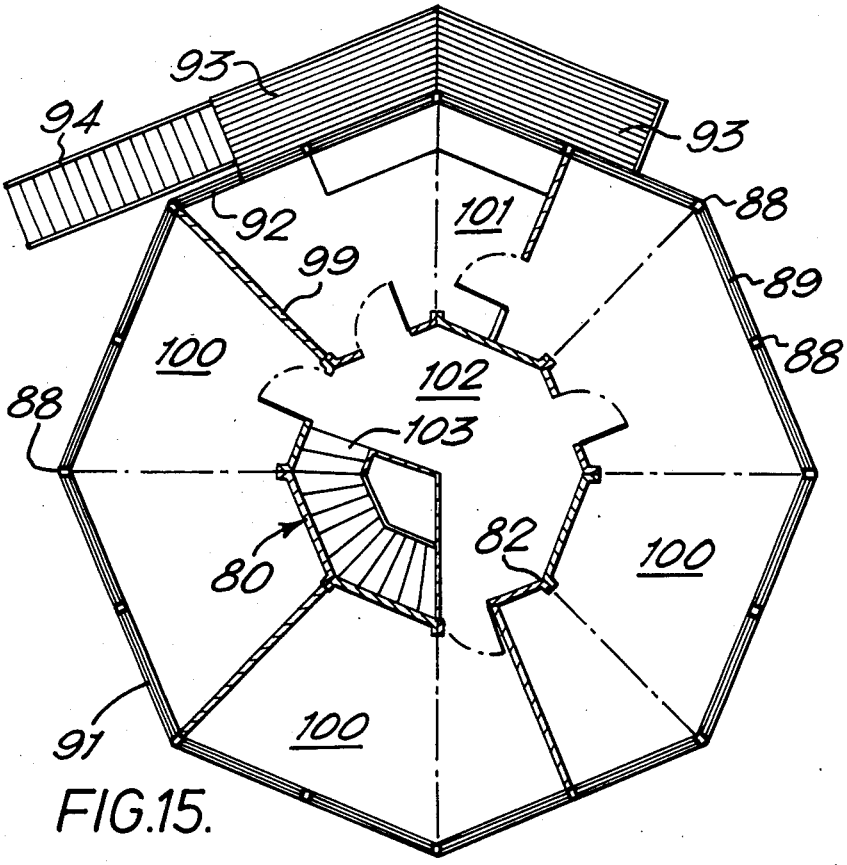
FIG.15.

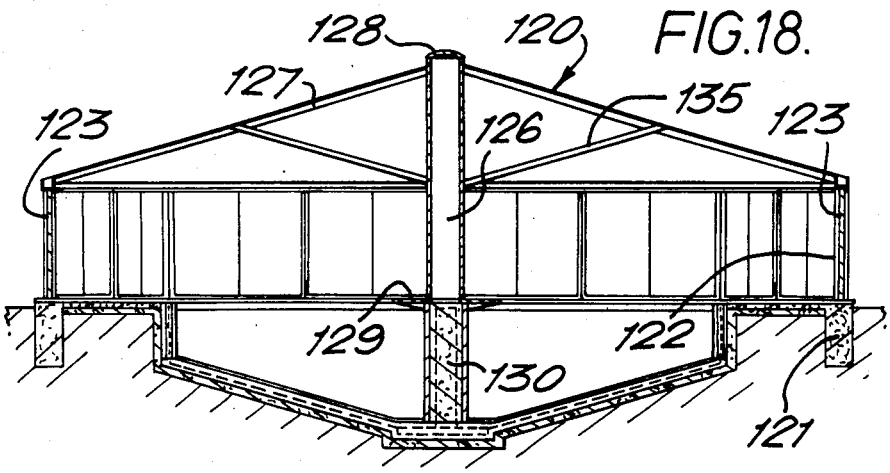
FIG.18.
FIG.19.
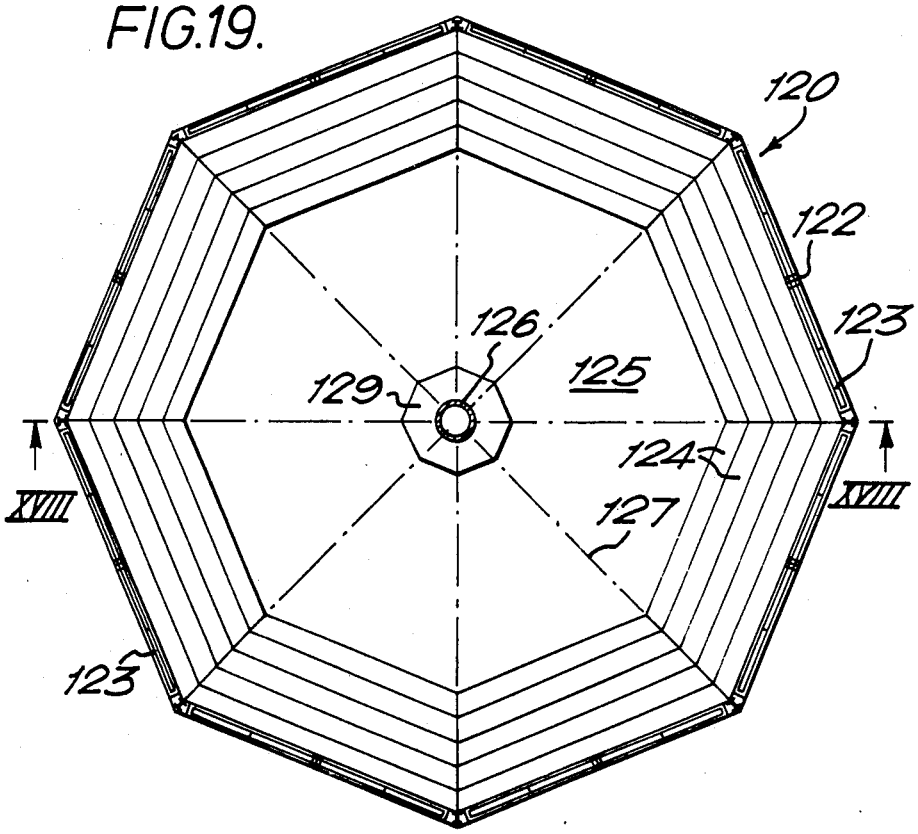

FIG.20.
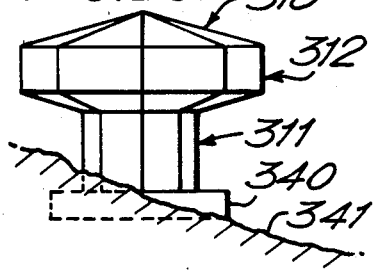
FIG.21.
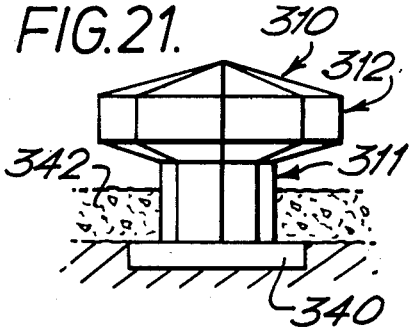
FIG.22.
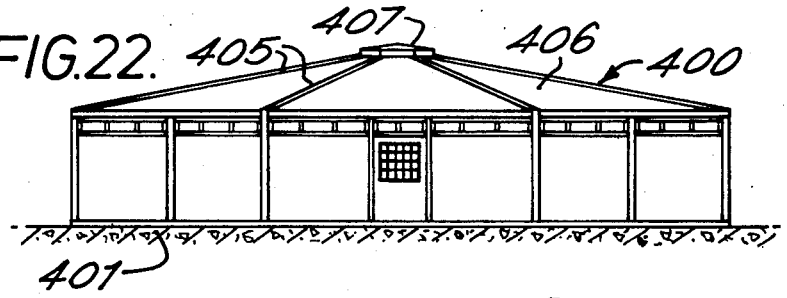
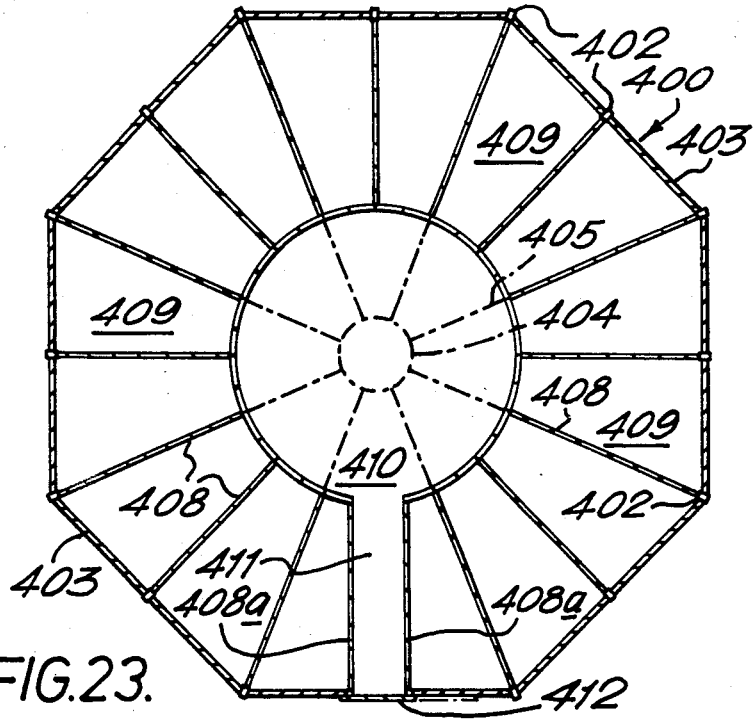
FIG.23.

FIG.30.
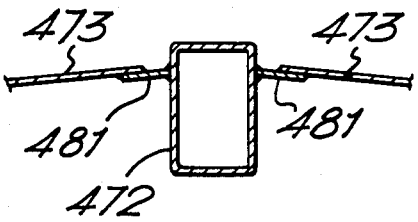
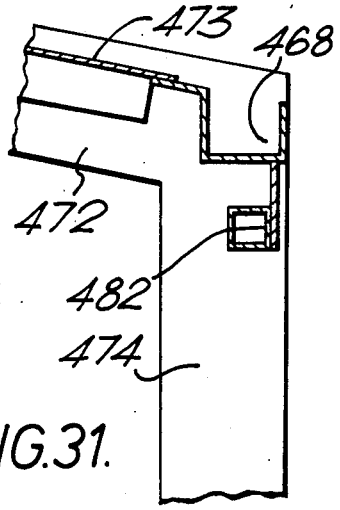
FIG.31.
FIG.32.
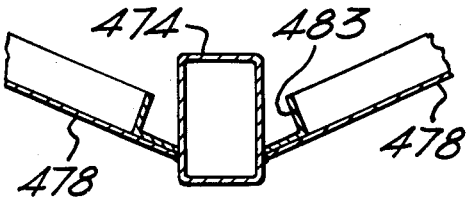
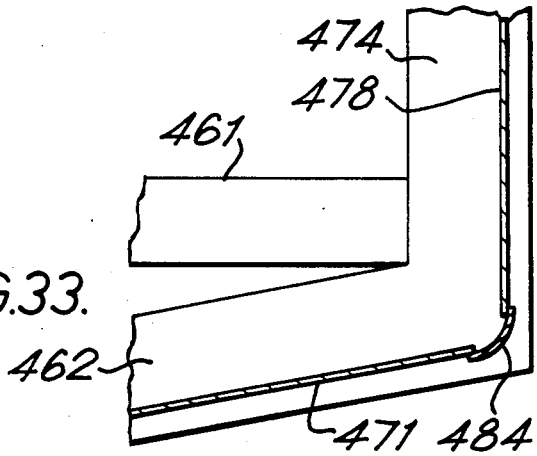
FIG.33.

BUILDINGS

This application is a continuation-in-part of application Ser. No. 388,674 filed June 15, 1982. (Now abandoned).

BACKGROUND TO THE INVENTION

This invention relates to buildings and is concerned with buildings constructed so that they may derive useful heat extracted from panels forming part of the buildings.

SUMMARIES OF THE INVENTION

According to the invention, a building comprises hollow, load-bearing structure, panels carried by the structure, and in thermal contact therewith, a heat sink, and means including a heat pump for circulating liquid heat transfer medium through the interior of the structure so as to extract heat from the panels and to transfer this heat to the heat sink.

The preferred heat transfer medium is water.

The hollow, load-bearing structure may be supported by upright support means and spaced from the ground with the hollow, load-bearing structure extending laterally of the upright support means, wherein the upright support means serves as said heat sink.

The hollow, load-bearing structure may be a regular polygon in plan, for example, a regular octagon, and preferably comprises a plurality of side wall members.

The upright support means may comprise a centrally-disposed member of tubular form.

The hollow, load-bearing structure may comprise a frame.

The hollow, load-bearing structure may comprise a ring structure connected to cantilever members supporting a floor structure.

The centrally disposed tubular member may extend to the upper region of the building and support roof structure comprising radially-extending cantilever members.

The hollow, load-bearing structure may comprise roof beams of metal, with the exterior panels welded to structure carried by the beams.

The hollow, load-bearing structure may comprise upright supports of metal, with the exterior panels welded to structure carried by the supports.

Flooring may be provided with liquid-circulating ducts to provide floor-heating.

The building may comprise a multi-storey building.

Two or more buildings may be interconnected so as to form a multi-building group.

BRIEF DESCRIPTION OF THE DRAWINGS

The invention may be performed in various ways and some specific embodiments with possible modifications will now be described by way of example only, with reference to the accompanying drawings, wherein:

FIG. 14 is a vertical section through the fourth building,

FIG. 15 is a plan view of the interior of the upper structure, and

FIG. 18 is a vertical section on the line XVIII—XVIII of FIG. 19, and

FIG. 19 is a plan view of the pool;

FIG. 20 is a fragmentary side view of a sixth building, and illustrates how steep slopes can be accommodated;

FIG. 21 is a fragmentary side view of the sixth building and illustrates how poor soil conditions can be accommodated;

FIG. 22 is a side view of a seventh building,

FIG. 23 is a horizontal section of the seventh building, and

FIG. 30 is a fragmentary end view, in section, of a room beam;

FIG. 31 is a fragmentary side view, in section, of a roof beam/upright support assembly;

FIG. 32 is a fragmentary plan view, in section, of a wall panel/upright junction;

FIG. 33 is a fragmentary side view, in section, of a wall panel/underfloor junction.

In the following disclosures, where possible, features of one building may be added to, or substituted for, features of other buildings.

DETAILED DESCRIPTION OF PREFERRED EMBODIMENTS

Figure 1:
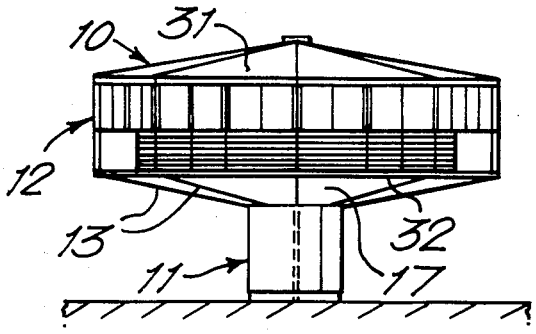
FIG. 1 is an elevation of a first building.
Figure 2:
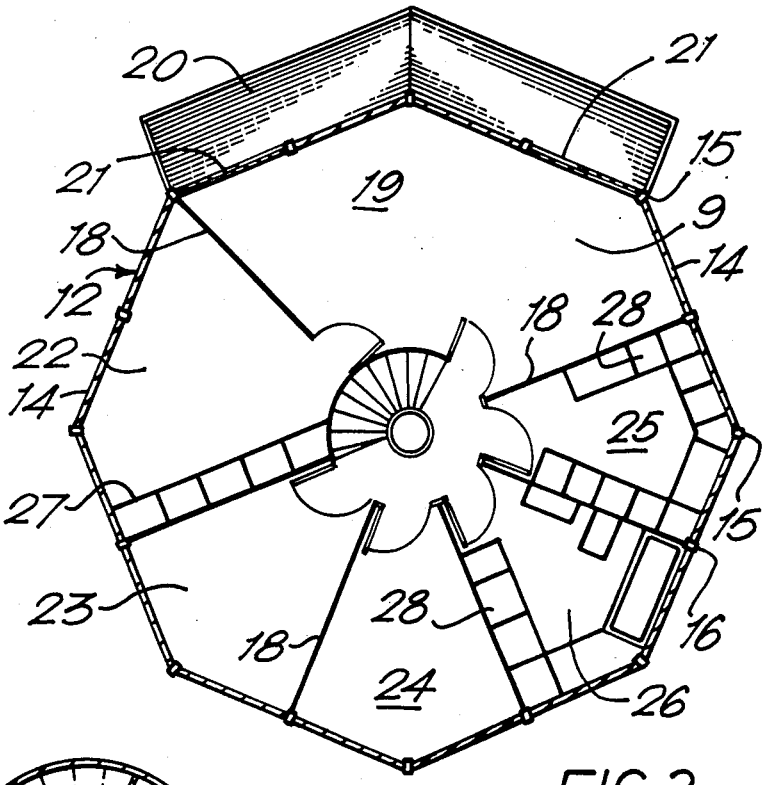
FIG. 2 is a plan view showing the accommodation in the first building.
Figure 3:
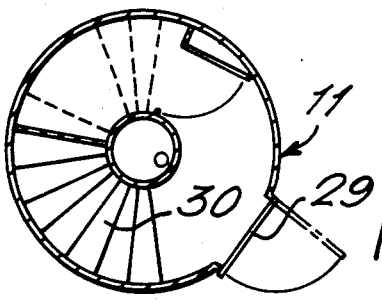
FIG. 3 is a plan view of a building access tube/support.
Figure 4:
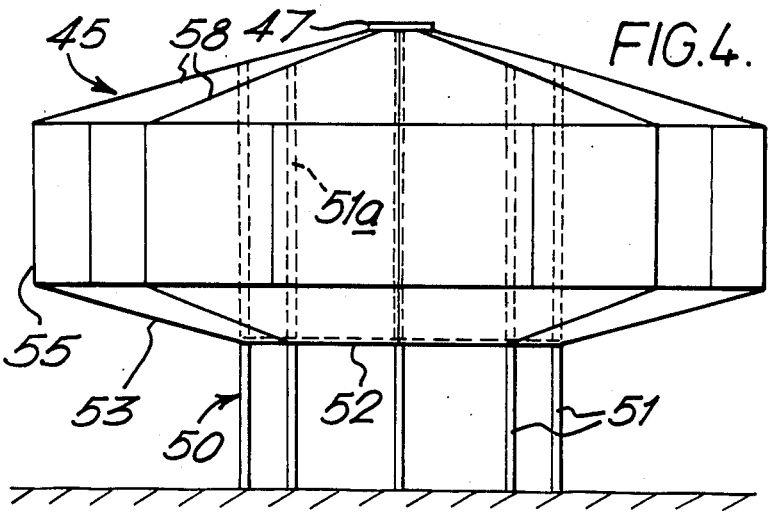
FIG. 4 is an elevation of a second building.

Referring to FIGS. 1 to 3, a building 10 comprises (central) upright support means in the form of a vertically-disposed tower or support 11 of tubular form, which is basically circular in section. The building 10 further comprises an eight-sided hollow structure 12 carried by the tubular support 11 and spaced from the ground. The hollow structure 12 extends laterally of the support 11. The horizontally-disposed floor 9 of the structure 12 is supported on cantilever supports 13 extending radially outwardly from the support 11. The structure 12 has eight contiguous panels or side walls 14 interconnected so as to form a regular polygon, as viewed in plan. Supports 15 are disposed at the junctions between adjacent walls 14. Further supports 16 are disposed mid-way along each wall 14. The supports 15, 16 extend upwardly and substantially vertically from the floor 9. Spaces between the cantilever supports 13, which extend upwardly as well as outwardly from the support 11, are filled in by suitable cladding 17.

Removable partitions 18 extend radially inwards from selected supports 15 or 16 so as to divide the interior of the structure 12 into convenient zones. In the arrangement shown, a three bedroomed house is provided having a living room 19 with a balcony 20 to which access can be gained through patio doors 21 in the walls 14 bounding the living room; bedrooms 22, 23, 24; a kitchen 25, and a bathroom 26. Wardrobes 27 and other storage units 28 are provided. Access to the structure 12 is by way of a door 29 at the foot of the central support 11, which has internal steps 30. The tubular support 11 may house domestic services such as gas, electricity, water and sewage. The annular space beneath the structure 12 may be closed in by walls so as to provide, for example, a garage, storerooms, and/or a greenouse.

The central support 11 may be provided with a raft or base so that it is heavier than the structure 12 it supports, thus resisting any tendency for the building to topple. This provision is particularly beneficial in earthquake-prone areas. The central support 11 can be extended beneath ground level to a depth sufficient to enable the complete building 10 to be erected on ground unsuitable for some conventional buildings.

The building 10 is of simple geometric form and occupies only a relatively small ground area. The foundations are simple and inexpensive. The building 10 is particularly suitable for "third world" countries and can include many components, such as the wall panels 14, which are factory produced and standardised, particularly where the building is a regular polygon. Manufacture of the building 10 is not labour intensive and is therefore inexpensive to construct.

Added strength is provided by sloping the roof 31 downwardly and outwardly and by sloping the external "floor" 32 upwardly and outwardly.

Each building of this disclosure makes use of the above-described arrangement; namely use of a hollow structure bounded by a plurality of panel-like wall members.

With reference to FIGS. 4 to 7, the central support need not be tubular. The figures illustrate a building 45 provided with a central support 50 comprising pillars 51, not necessarily on a circle but, for example, possibly at the corners of a square, or other formation, as shown. The spaces between the pillars are preferably sheeted in.

The building 45 of FIGS. 4 to 7 comprises a steel frame comprising members bolted or welded together. Cantilever members 53 supporting a floor structure 54 extend between, and are connected to, a ring frame 52 and upright members 55. The upright members 55 support a roof structure 56. The roof and floor structures comprise upper and lower radially-disposed members 58, 53 extending outwardly to the upright members 55 and laterally spaced members 59 disposed parallel to the side walls 46 of the building 45. The inner ends of the upper members 58 are connected to a central support ring 47. The building 45 is provided with a balcony 57.

Figure 5:
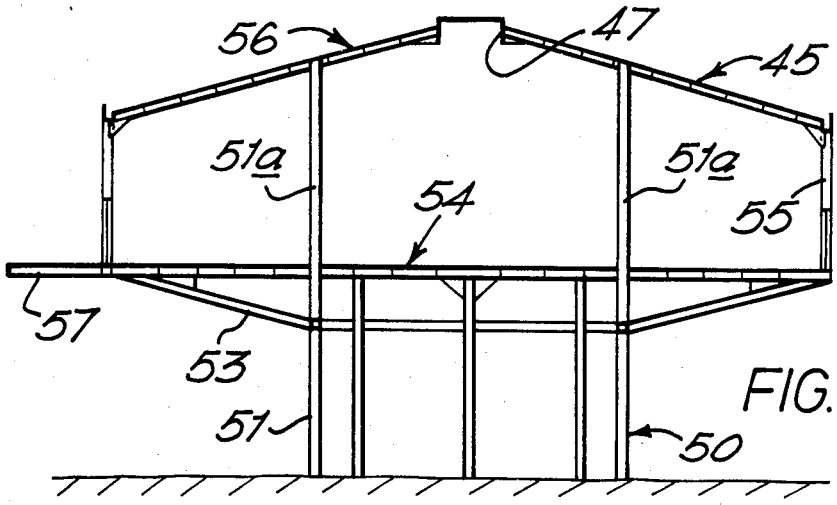
FIG. 5 is a vertical section through FIG. 4.

With reference to FIG. 5, certain of the pillars 51, for example alternate pillars, extend upwardly above the floor structure 54, as indicated by reference 51*a*, and are connected to the roof structure 56 so as to support it.

Figure 7:
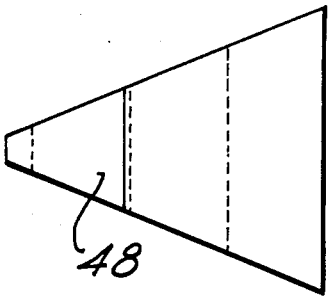
FIG. 7 is a plan view of a building unit.
Figure 6:
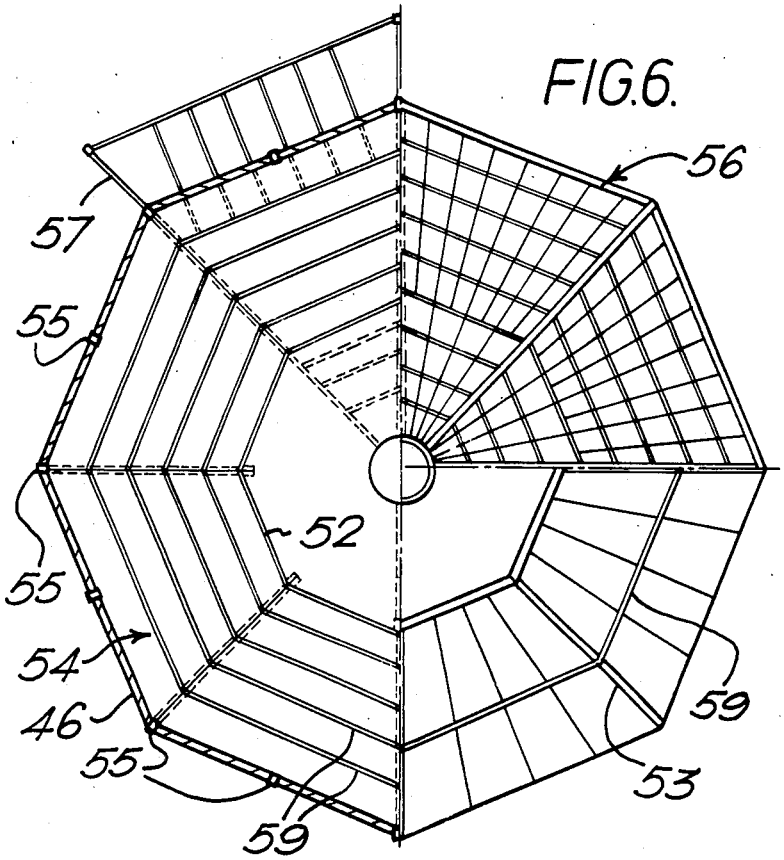
FIG. 6 is a plan view showing structural details at various levels.

The roof and bottom are clad with suitable panels or plating 48 illustrated in FIG. 7.

The completed weathering steelwork is sprayed internally with 3.2 cm (1¼ inches) of urethane foam giving good thermal insulation. Calculations indicate that the running costs and maintenance of the building will be less than conventinal buildings of comparable floor area.

The building is substantially free of draughts.

The building frame is preferably constructed from high yield steel (BS 4760/50 grade).

Referring now to FIGS. 8 to 12, which illustrate a building 76 similar to that shown in FIG. 1, the building comprises a central vertical support tube 60 carrying a hollow structure 77. The tubular support 60 is a 4 mm CORTEN "A" tube of 1.9 m outside diameter, connected to a steel floor frame 61. The floor frame 61 is supported on angularly spaced web frames 62, the lower inner ends of which are connected to a "T"-ring frame 63. An inner central support tube 64, for example a 4 mm CORTEN "A" tube of 600 mm outside diameter, extends to the upper region of the building 76. Upper and lower ring frames 65, 66 respectively are connected to the tube 64 and support a floor structure 61 and a roof structure 67. The roof structure 67 includes a peripheral gutter 68, angularly spaced radial flat bars 69, and laterally spaced angle bars 70. The roof is provided with cladding panels, and the web frames are provided with cladding panels 71.

The roof structure 67 comprises I-section roof cantilever beams 72. The beams 72 extend radially outwards from the central support 64 and support roof panels 73. The outer ends of the cantilever beams 72 are connected to box section pillars 74 with double beam knees 75.

The hollow structure 77 of building 76 makes use of side wall panels 78 secured to the pillars 74.

Figure 13:
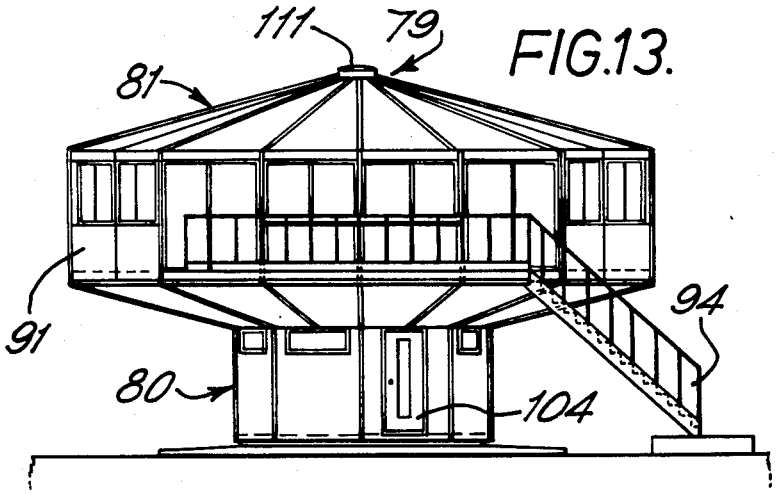
FIG. 13 is a north elevation of a fourth building.
Figure 16:
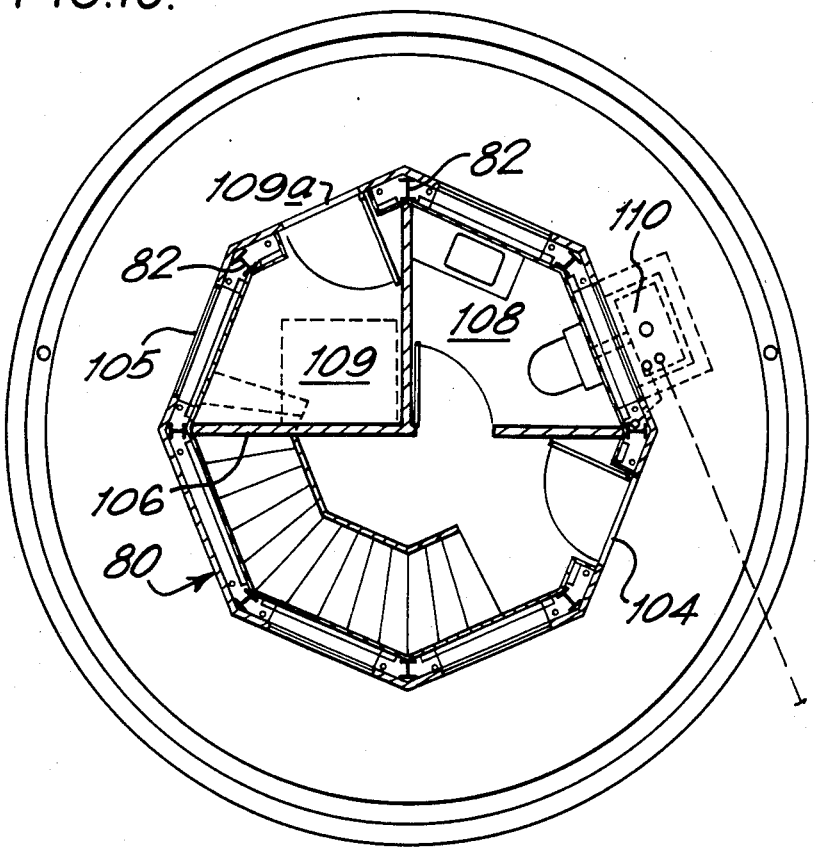
FIG. 16 is a plan view of the interior of the central support.

Referring now to FIGS. 13 to 15, which illustrate a marine office/control tower 79, the building comprises a central support structure 80 octagonal in plan carrying an upper structure 81 also octagonal in plan. The corners of the octagonal structure 80 are defined by upright columns 82 disposed on foundation piles 83 and forming part of a structural steel frame 84. The frame 84 includes a floor structure 85, a roof structure 86 having a peripheral fibreglass and carried in part on the columns 82, and cantilever bottom beams 87. Upright supports 88 are provided at the junctions and mid-points of the edge beams 89 to provide support for the roof structure 86. Suitble glazing, for example tinted glass, is provided. Side wall panels 91 of fibreglass material are provided between the uprights 88 and are connected thereto. Sliding doors 92 lead to a balcony 93 provided with an external steel access staircase 94. The floor 95 is provided by shipboard on timber joists on the steel frame. A reinforced concrete floor 96 for the support structure 80 rests on a concrete foundation or raft 97 with perimeter paving 98 having drain discharge channels. The roof is provided with fibreglass panel cladding with urethane foam insulation.

As seen in FIG. 15, the internal space of upper structure 81 is provided with timber partitions 99 and appropriate doors to give offices 100 and control room 101. A landing 102 may be reached by staircase 103 from the inside of the support structure 80 which has an entry door 104. The support structure 80 has fibreglass wall panel cladding 105 including urethane foam insulation and has internal walls 106 providing entrance hall 107, toilet 108, equipment room 109 which has an external door 109*a*. A sewage lifting pump 110 is provided. A translucent and ventilating dome light 111 is provided at the centre of the room.

Figure 17:
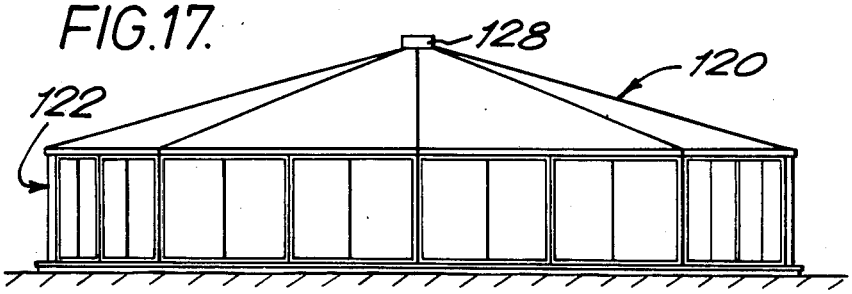
FIG. 17 is an elevation of a fifth (swimming pool) building.

Referring to FIGS. 17, 18 and 19, a swimming pool building 120, octagonal in plan form, has a perimeter concrete foundation or raft 121 supporting posts 122 at the junctions and mid-points of the right side wall panels 123, which are in the main provided with double-glazed patio doors. Non-slip pool surround paving 124 is at the edge of the eight-sided pool 125 whose walls are constructed with hollow concrete blocks filled with vibrated concrete and reinforced with mild steel rods both horizontally and vertically. The pool walls are backed with reject stones. The pool floor is constructed with concrete reinforced with mild steel mesh fabric on a polythene membrane on reject stones.

A central steel tubular colume 126 and radially disposed upwardly extending struts 135 provide major support for the roof 127. The posts 122 provide additional support at the roof periphery. The upper end of the column 126 is covered by a ventilated dome 128. A central safety platform 129 is fixed to the column 126. The roof is clad with "CORTEN" steel plate. The column 126 rests on a vertical pipe 130 filled with reinforced concrete.

Referring to FIGS. 20 and 21, a building 310, (similar in form to that illustrated by FIGS. 1, 2 and 3), has central vertical support means in the form of a tube 311 which is basically circular in section and which supports an eight-sided structure 312 which is spaced from the ground and extends laterally of the support 311.

The central tower/support 311 is disposed on a concrete raft 340 so as to be supported thereby. Thus, as illustrated by FIG. 20, steep slopes 341 can be accommodated. Furthermore, and as illustrated by FIG. 21, poor soil conditions, indicated by soil layer 342, can be accommodated.

FIGS. 22 and 23 illustrate a stable building 400 comprising a structure which is a regular polygon, (actually an octagon), in plan form.

The building 400 has a perimeter concrete foundation 401 supporting posts 402 at the junctions and mid-points of the eight side wall panels 403.

A central steel ring 404 and radially disposed downwardly extending cantilever beams 405 connected thereto provide major support for the roof 406. The posts 402 and partitions 408 (referred to below) provide additional support for the roof. A translucent and ventilating dome 407 is provided at the centre of the roof 406 and is supported by the ring 404.

The partitions 408 extend radially inwards from the "corner" posts 402 to divide the major part of the building into sixteen separate stables 409 surrounding a central work or exercise area 410 to which access is obtained by way of a corridor 411, (flanked by partitions 408*a*) and a door 412.

Figure 24:
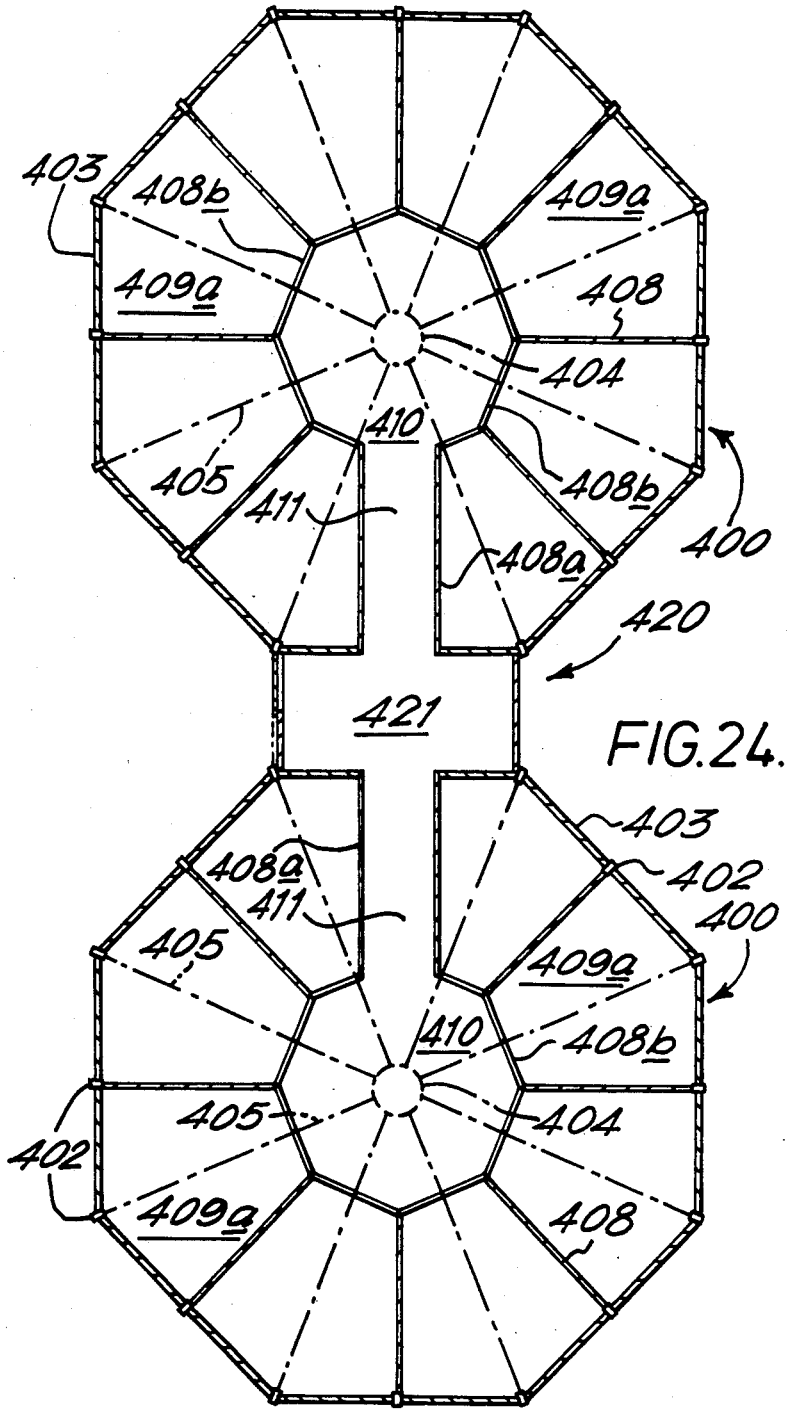
FIG. 24 is a plan view, in section, of a modification of the building illustrated by FIGS. 22 and 23.

FIG. 24 illustrates a building 420 serving as a double stable. The building comprises two slightly modified buildings 400 interconnected by an access passage 421 to form a multi-building structure or group. Each building is provided with eight separate stables 409*a*. Partitions 408, as well as partitions 408*a*, which flank areas 410, may be used to provide support for beams 405.

Figure 25:
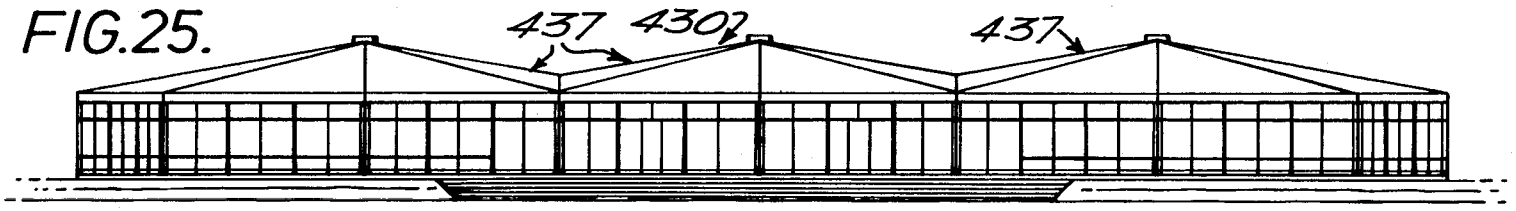
FIG. 25 is a side view of an eighth (swimming pool) building.
Figure 26:
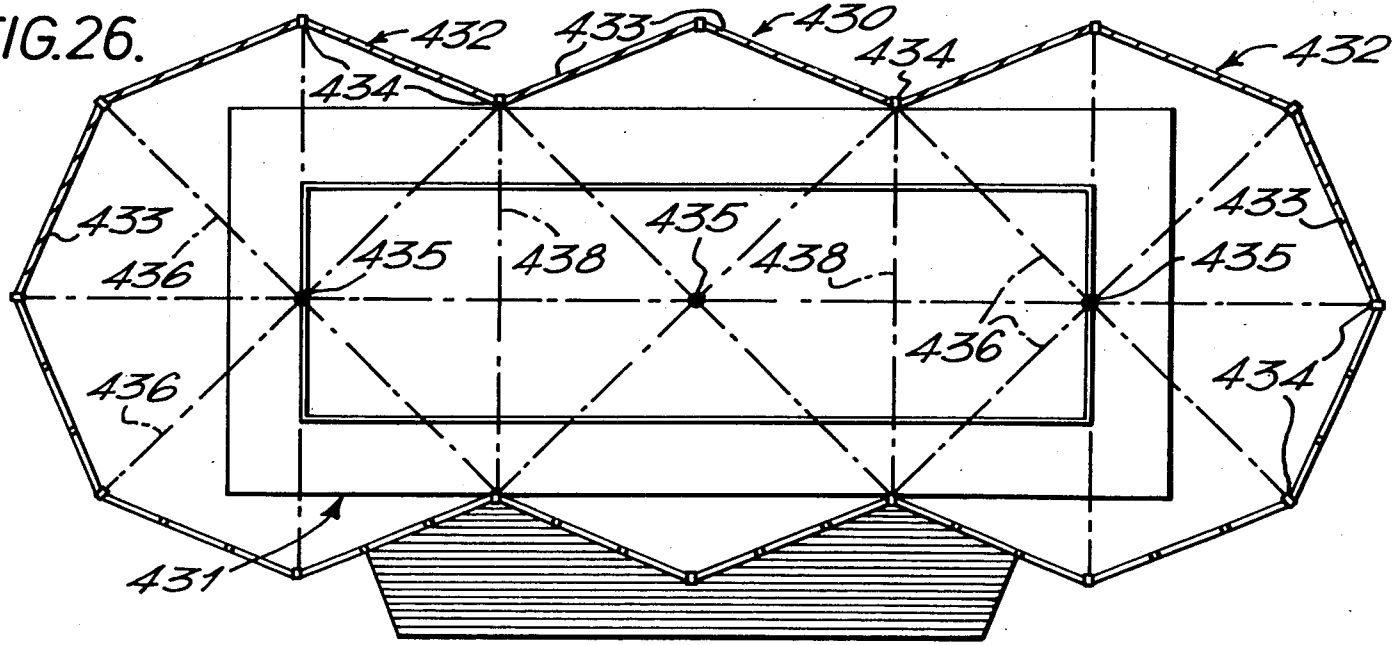
FIG. 26 is a plan view, in section, thereof.
Figure 27:
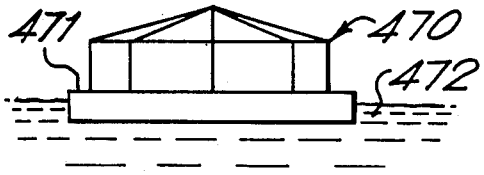
FIG. 27 is a side view of a ninth and buoyant building.

FIGS. 25 and 26 illustrate a building 430 providing shelter for a swimming pool 431 (FIG. 26) of rectangular plan form. The building 430 comprises, in effect, two octagonal buildings 432 with side wall panels 433 interconnected by further walls 433. The walls 433 are supported by posts 434. Central steel rings 435 and radially-disposed beams 436 provide support for the three-part roof 437, as do laterally-extending beams 438 extending oppositely-disposed posts 434., Buildings according to the invention need not be confined to land areas. FIG. 27 illustrates a building 470 supported by a buoyant structure 471 whereby the building can float on water 472. The structure 471 is preferably of octagonal plan form so that a plurality of buildings 470 can nest together in contiguous relationship. Buildings 470 have particular application in areas where land is scarce, or where flooding is common.

Figure 28:
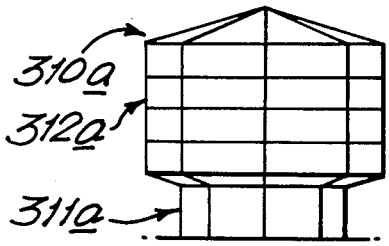
FIG. 28 is a side view of a tenth building.

FIG. 28 illustrates a "high-rise" building 310*a* basically similar to that illustrated in FIGS. 20 and 21, but having a multi-floor eight-sided structure 312*a* supported by a central tower 311*a*.

FIGS. 29 to 33 illustrate details of a steel frame load-bearing structure that may be employed to derive useful heat extracted from exterior panels forming part of a building. Reference numerals used in FIGS. 29 to 33 correspond to like components shown in the building of FIGS. 8 to 11.

Figure 8:
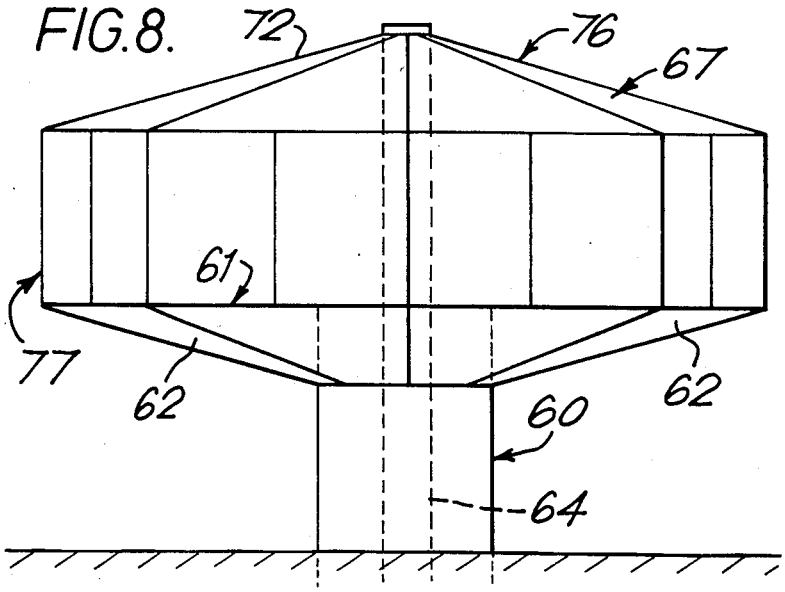
FIG. 8 is a side elevation of a third building.
Figure 9:
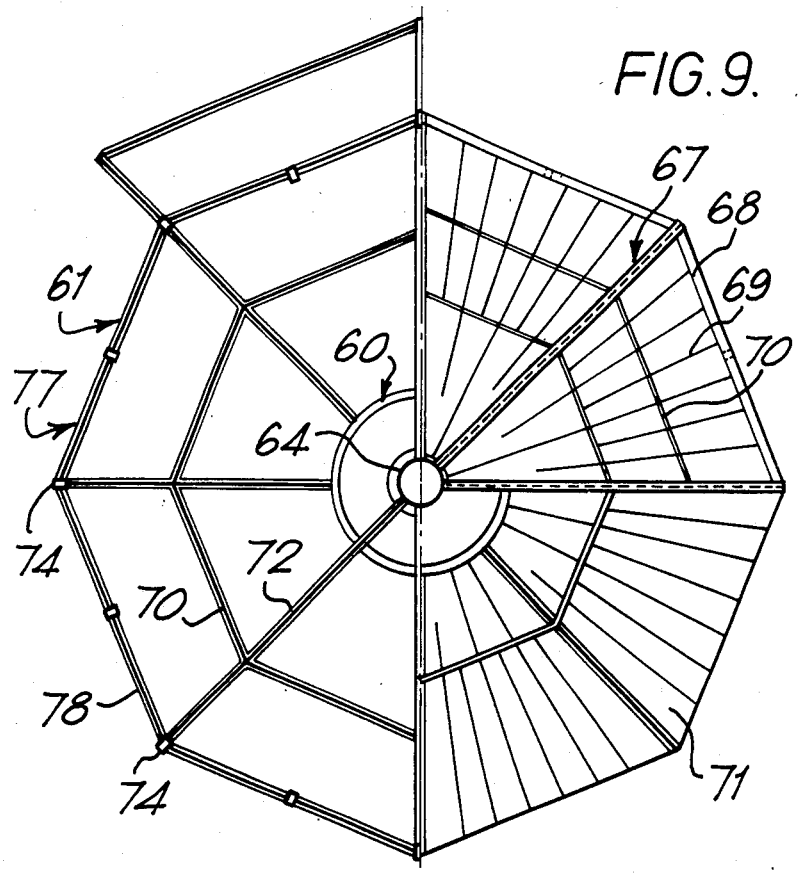
FIG. 9 is a plan view at various levels of the third building.
Figure 10:
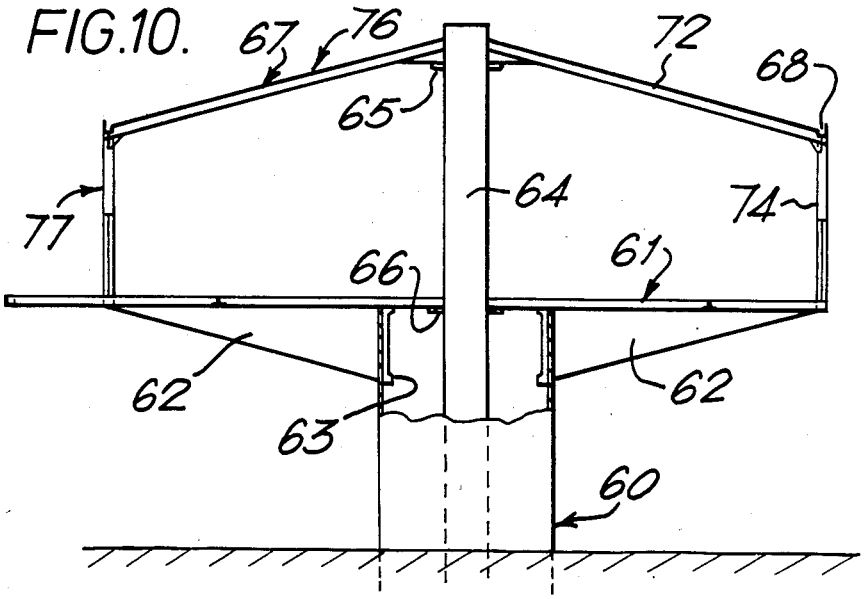
FIG. 10 is a vertical section through FIG. 9.
Figure 11:
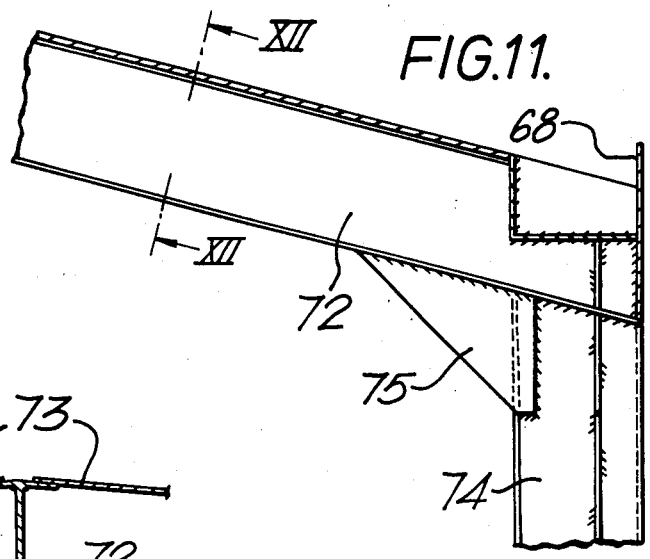
FIG. 11 shows a detail of FIG. 10 on an enlarged scale.
Figure 12:
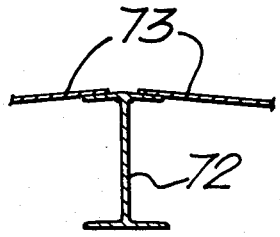
FIG. 12 is a section on the line XII—XII of FIG. 11.
Figure 29:
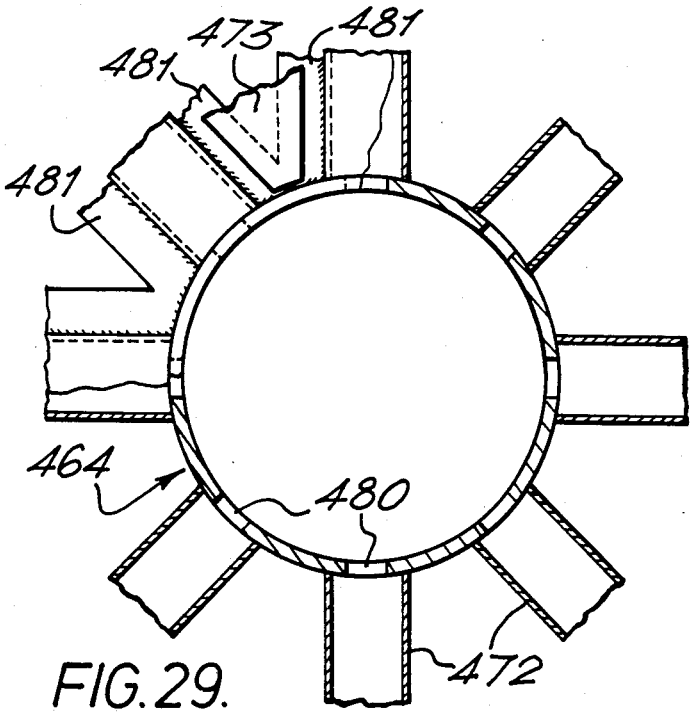
FIG. 29 is a plan view of a central support tube.

FIG. 29 shows a centrally-disposed support tube 464, (which corresponds to tube 64 of FIG. 8). Eight equispaced cantilever roof beams 472 of hollow construction extend radially outwards from the upper end of the tube 464. A ring of apertures 480 formed in the upper end of the tube 464 permit communication between the tube and interiors of the hollow beams 472.

With additional reference to FIG. 30, plates 481 of steel welded to the sides of the beams 472 support steel roof panels 473 welded in turn to the beams. The roof panels 473 are thus in good thermal contact with the supporting roof structure formed by the beams 472.

FIG. 31 illustrates a junction between the outer extremity of a roof beam 472 and an upright support 474, also of hollow form. In addition, a gutter 468 is shown, as well as a window/door frame head 482.

FIG. 32 illustrates a junctio between an upright support 474 and steel wall panels 478 in thermal contact therewith. The junction is made by way of angle bar 483 welded to the upright support 474.

FIG. 33 illustrates a junction between an upright support 474, hollow floor beams 461 and hollow floor support beams 462. Panels 471 are welded to, and thus in thermal contact with, the beams 462. Adjacent edges of the exterior wall panels 478 and exterior panels 471 beneath the floor are joined by a curved strip 484.

Welding of the panels 471, 473, 478 to their support structure is preferred as this method of attachment ensures good heat-transfer relationship between the panels and the structure.

The steel frame structure illustrated by FIGS. 29 to 33, employing as it does hollow components, which define flow ducts, can be used in the following manner.

The frame structure and support tube are filled with water, treated with anti-freeze and agents to inhibit reaction with the steel used by the structure and tube. The central support tube 464 is enclosed in heat-insulating material. (Not shown in FIG. 29).

Figure 35:
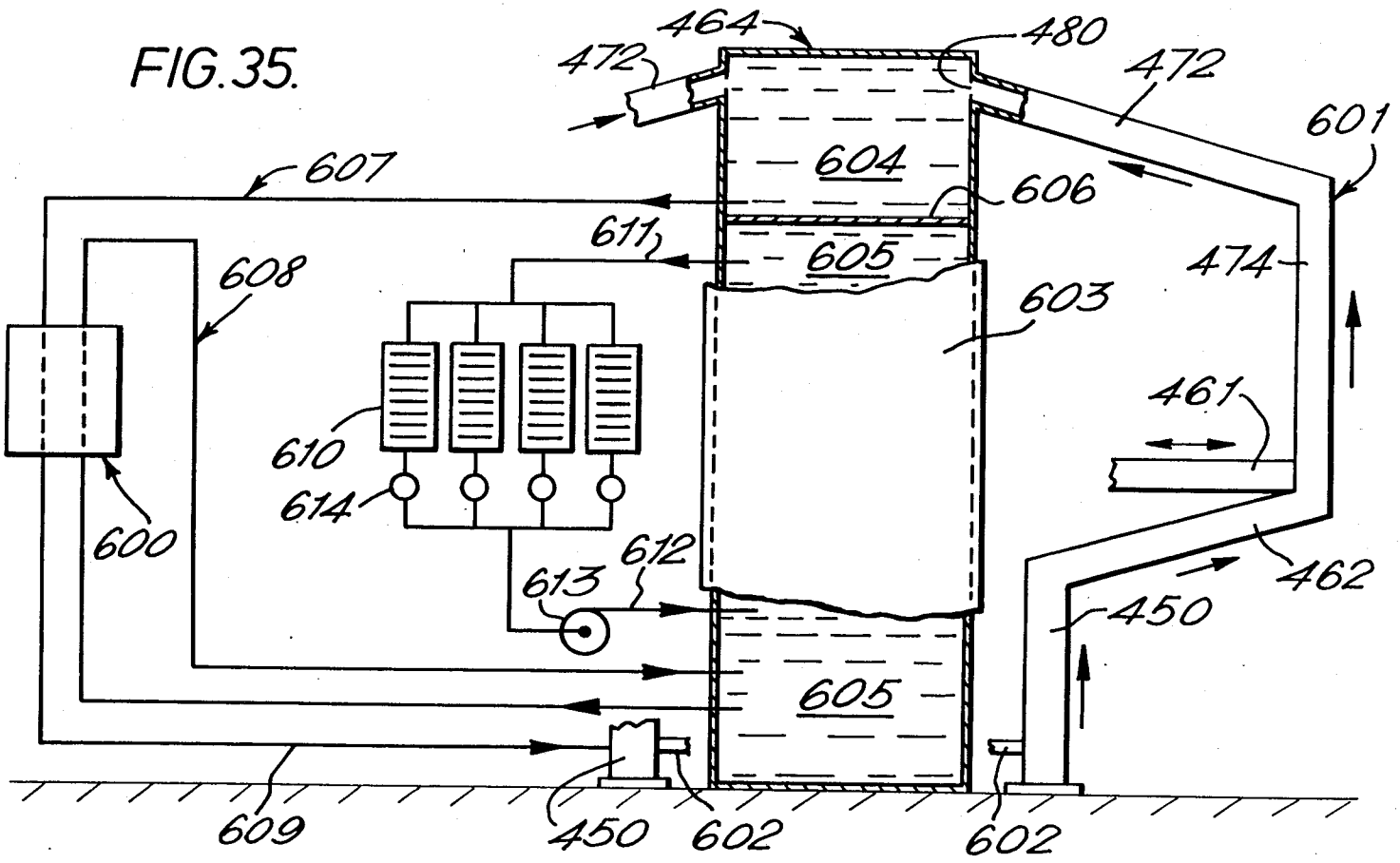
FIG. 35 is a side elevation of an eleventh building, which incorporates structure illustrated by FIGS. 29 to 33.

With reference now to FIG. 35, a heat pump 600, a water/water heat heat transfer system, circulates the water, whereby solar and other ambient heat is extracted from the roof, wall and floor panels 473, 478 and 471, as well as exposed portions of the associated support structure, and transferred to the heat sink receptacle provided by the tube 464.

FIG. 35 does not show the panels 471, 473, 478 but it does show the hollow structure 461, 462, 472, 474 which provides support for the panels. For convenience, this support structure is identified by reference numeral 601.

The floor beams 461, (which provide floor heating), interconnect oppoositely-disposed upright supports 474. The interiors of the floor beams 461 and upright supports 474 are in communication with each other. The structure 601 is supported by a ring of equi-spaced hollow columns 450 disposed around the tubular support 464 and rest upon the ground. The interiors of the columns 450 (which form part of the structure 601), are in communication with the interiors of the beams 462 and thus with the remainder of the hollow structure. The lower ends of the column 450 interiors are interconnected by a pipe 602 which serves as a "ring-main".

The centrally-disposed support tube/heat sink 464 is enclosed in heat-insulating material 603. The interior of the structure 464 is divided into upper and lower heat-sink chambers 604, 605 by a diaphragm 606 which is heat-insulated so as to limit the transfer of heat between water in the chambers.

Water in the structure 601 (and pipe 602) is in communication with the upper chamber 604 by way of apertures 480.

The heat pump 600 incorporates two closed circuits, namely 607 and 608. Circuit 607 draws water from the upper chamber 604 and returns it to the chamber by way of the structure 601, using a line 609 tapped into one of the columns 450.

Circuit 608 draws water from the lower end of lower chamber 605 and returns it to the chamber at a slightly higher (3 ft) level.

An solar and other ambient heat is transferred from the panels 471, 473 and 478 to their water-filled supporting structure 601, this useful heat is first passed to the heat pump, (by way of circuit 607), and thereafter to the mass of water in the lower chamber 605, (by way of circuit 608). Some ambient heat is collected directly by the exposed parts of the structure 601.

It is expected that a drop in temperature of 5° F. below ambient at the external surfaces of the building will result in an average water temperature of 120° F. within the chamber 605.

Central heating radiators 610 are connected by flow (611) and return (612) lines to the upper and lower ends of the chamber 605. A circulating pump 613 and individual motorised valves 614 are fitted in the return line 612.

The motorised valves 614 are controlled by individual thermostat devices (not shown) disposed in the living spaces of the building served by the radiators 610.

In addition to its heat extraction transfer function, the water-filled frame structure 601 also provides the building with a good measure of protection against fire.

In a non-illustrated modification, rods or similar members of elongate form are suspended from the outer ends of cantilever roof beams. The vertically-disposed rods are used to support wall panels.

Figure 34:
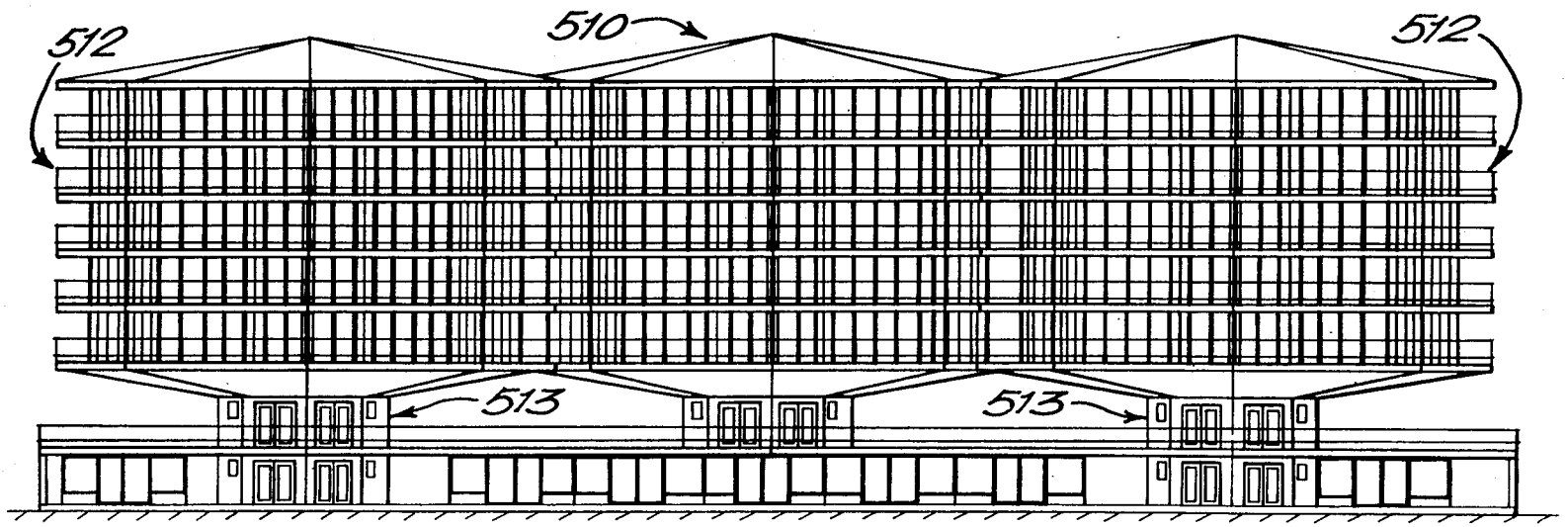
FIG. 34 is a side view of a group of multi-storey buildings.

FIG. 34 illustrates how a plurality of multi-storey buildings (510) according to the invention can be used to provide a multi-building group of flats, in this particular case, holiday flats. The buildings 510 may be separate or interconnected as illustrated by FIG. 24.

Figure 37:
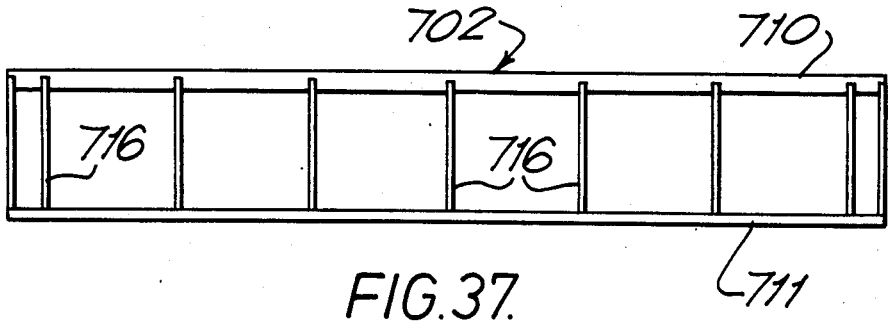
FIG. 37 is a side view of the roof.
Figure 36:
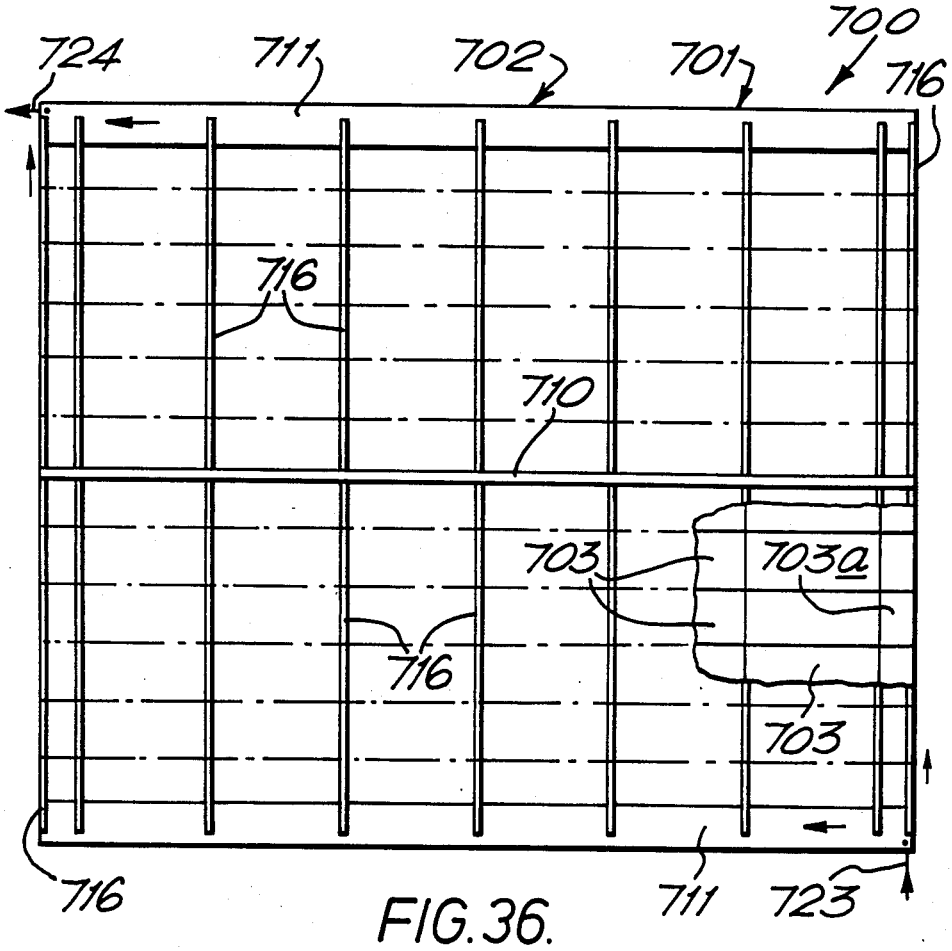
FIG. 36 is a plan view of a roof for a twelfth building.
Figure 38:
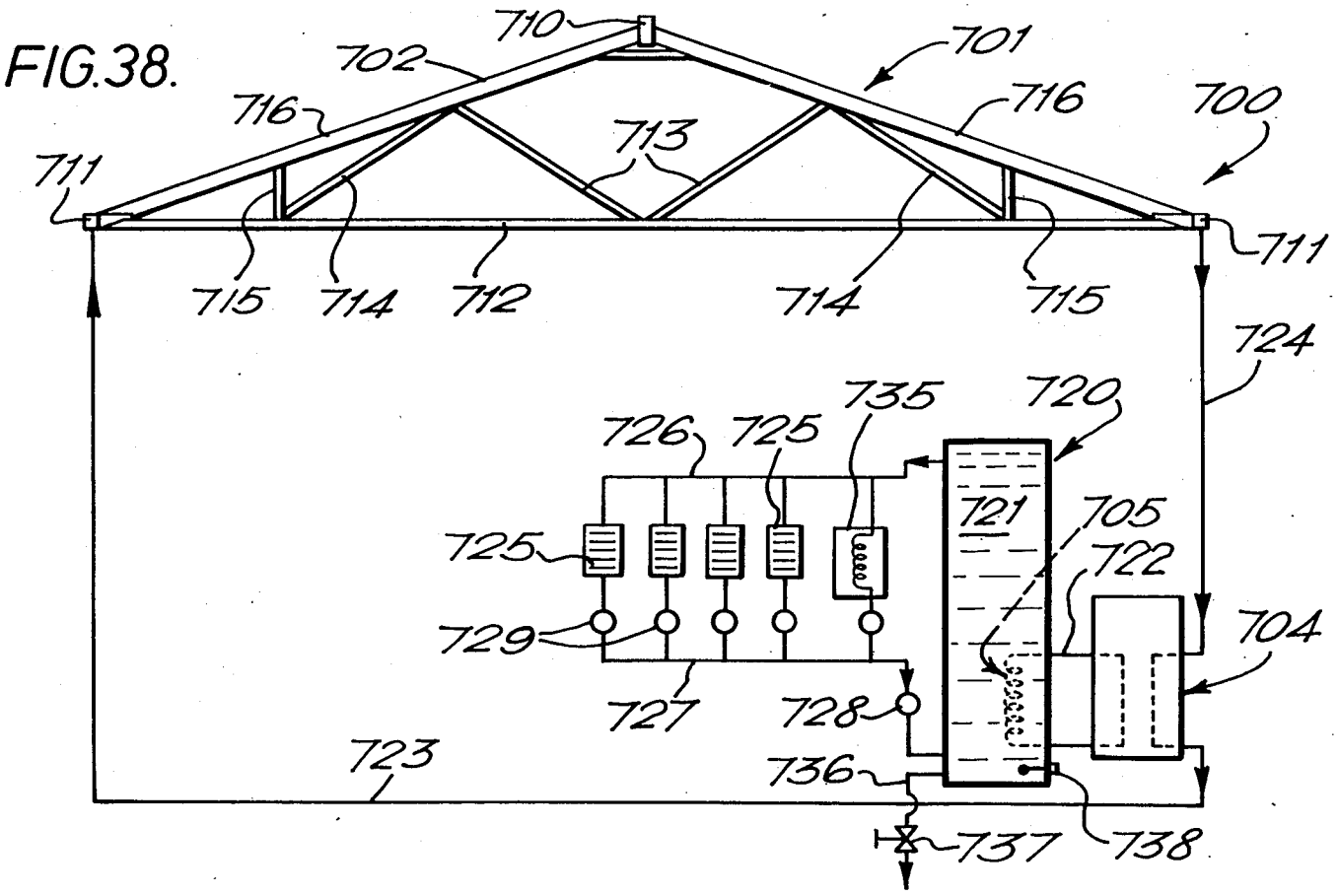
FIG. 38 is a sectional view of the roof, with added semi-diagrammatic features.

With reference now to FIGS. 36, 37, 38, a conventionally shaped, gable-ended roof 701 of a building 700, (not shown in its entirety), comprises hollow, load-bearing structure 702, with sheets 703, 703*a* covering the structure 702 and in thermal contact therewith, a heat pump unit 704 for circulating liquid heat-transfer medium (water) through the interior of the structure 702, and a heat exchanger 705 for extracting useful heat from the medium.

The roof structure 702 and sheets 703, 703*a* in this example are of steel, with the sheets welded to the structure so as to be in good thermal contact therewith. However, suitable alternative materials and securing methods which preserve good thermal conductivity may be used. For example, the sheets may be of aluminum and releasable bolts or clips may be employed to secure the sheets in place and ensure good heat-transfer relationship with the roof structure 702.

The roof structure 702 comprises a longitudinal ridge (710), eaves (711), ties (712), struts (713, 714, 715) and rafters (716) all interconnected, for example, by welding. The hollow interiors of the eaves 711 serve as inlet and outlet manifolds for the circulating water. The rafters 716 interconnect the eaves 711. Other hollow interiors of the roof structure 702, for example, the struts 713, 714, 715, may be used as part of the water-conducting, heat-transfer path defined by the interior of the roof structure.

Water used for circulation through the roof structure 702 contains an anti-freeze solution, also a corrosion inhibitor.

As shown in FIG. 38, most of the water is contained in a heat sink 720. The heat sink 720 comprises a large, heat-insulated, container and may be employed as a structural part of the building which makes use of the roof 701. Preferably, the heat sink 720 would then be used as a centrally-disposed roof support.

The heat exchanger 705 is disposed in the mass 721 of water contained in the heat sink 720. The heat exchanger 705 forms part of a closed circuit 722 connected to the heat pump 704. Also connected to the heat pump 704 are flow (723) and return (724) lines which conduct water to and from the eaves 711, whereby the water is circulated through the interior of the roof structure 702. The lines 723 and 724 may comprise hollow, load-bearing structures. (For example, structures equivalent to uprights 474 of FIGS. 31 and 32).

Central heating radiators 725 are connected by flow (726) and return (727) lines to the heat sink 720. A circulating pump 728 and individual motorised valves 729 are fitted in the return line 727. The valves 729 are controlled by individual thermostats, (not shown), disposed in the living spaces of the building served by the radiators 725. An indirect cylinder 735 is connected between the flow and return lines 726, 727. The heat sink 720 is provided with a drain line 736 having a flow control valve 737, as well as an electrically powered back-up heater 738. In operation, solar and other ambient heat absorbed by the steel plates 703, 703*a*, is conducted to the water circulating in the hollow structure 702, and then transferred to the mass of water 721 by way of the heat pump 704.

Steel is the preferred material used in the construction of the roof structure 702 for the following reasons:

(1) It is readily available and offers a wide choice of sections and sheets to suit any requirement.

(2) It is easily fabricated and with simple jigging precision components can be manufactured by a large number of under-utilised fabrication workshops in most areas of the country.

(3) A wide range of coatings is available to produce almost any desired colour or texture required which are virtually maintenance free.

(4) Lightweight buildings can be produced by ensuring that all redundant structure is eliminated.

(5) When fully welded or bolted, structures can be produced that are resistant to earth tremors or natural subsidence which adversely affect traditional structures, making it possible to utilise sites with poor subsoil conditions.

(6) Using sheet steel for the skin of the buildings or for the roof areas, solar energy at all times present in the atmosphere can be conducted into the buildings and stored for use internally.

The arrangement, unlike other solar heating systems, can make full use of structure required to contain a space and need not be an attachment to a building.

All of the structural members of the roof 701 that require half an hour fire protection under Building Regulations are water-filled. The water, which contains anti-freeze and corrosion inhibitors, is used in three ways :

(a) To provide fire protection to the structural steelwork. (Roof beams not requiring fire protection under the regulations are used as water storge to replace evaporated water in the event of fire).

(b) The corrosion inhibitors protect the hollow section structural members against internal corrosion.

(c) The water-filled structure is connected to the heat pump 704 which circulates the water around the structure 702 and extracts useful heat gathered thereby. The water within the structure 702 is thus reduced in temperature below the ambient air temperature. This causes a continuous conduction of heat from the shell of the roof into the water. The heat extracted is transferred via the heat pump 704 to the water-filled heat sink 720 which may comprise a tank under the floor, but preferably comprises a structural part of the building. Heat within the sink 720 is made available for use within the building by conventional heating technology.

The cost of providing a roof structure 702 or a complete building having the roof structure, is similar to that of a conventional roof or building.

It is preferred, however, to construct buildings using simple geometric forms, (as described herein), for ease of manufacture, transportation and erection.

The running costs of a building 700 using the invention are considerably lower than that of a conventional building as the heat pump 704 is working in tandem with the sun.

Tests indicate that the energy costs will be approximately one third of a conventional heating system.

Existing roofs may be replaced by roofs according to this aspect of the invention.

The invention is not, of course, confined to roof structures. Alternatively, or in addition, a building may be provided with other structures according to this aspect of the invention. For example, walls.

With reference to FIGS. 30 to 33, the panels 471, 473, 478 need not be carried by the sides of the hollow, load-bearing structure. Instead, the panels may be welded to back portions of the structure so as to expose a larger surface of water-filled structure to the atmosphere.

The roof (and other structure) of the building of FIGS. 36, 37 and 38 can be similarly modified, in order to expose at least part of the water-filled structure to the atmosphere.

I claim:

1. In a building, a temperature-conditioning system comprising a hollow, primary, load-bearing frame structure, said primary load-bearing frame structure comprising roof beams, floor beams and upright supports, the upright supports comprising columns extending vertically from a ground surface for transmitting the primary roof and floor loads to the ground surface, said hollow frame structure being of metal, thermal conducting material, a liquid, fire-extinguishing, heat-transfer medium contained in said hollow roof beams, floor beams and upright supports and circulatable therethrough, the interior of said load-bearing frame structure defining communicating, liquid-conducting tubular ducts having a thin wall thickness relative to the duct cross section, thin, sheet-like metal panels comprising ambient heat collectors of a thermal-conducting material carried by and disposed on the hollow load-bearing frame structure and in direct thermal-transmitting contact therewith, a heat sink within said frame structure and in communication with the hollow, primary, load bearing frame structure and containing said liquid, fire-extinguishing, heat-transfer medium, and means including a heat pump operatively connected to said hollow, primary load-bearing frame structure for circulating the fire-extinguishing, liquid heat transfer medium through the interior of the hollow roof beams, floor beams and upright supports of said load-bearing frame structure so as to extract ambient heat from said thin, metal panels and transfer said ambient heat to said heat sink through the hollow roof beams, floor beams and upright supports and affording a measure of fire protection to the building.

2. In a building, a temperature-conditioning system comprising a hollow, load-bearing frame structure of a metal, thermal-conducting material, the interior of said frame structure defining communicating, liquid-conducting ducts having a thin wall thickness relative to the duct cross section, panels carried by the hollow, load-bearing frame structure and in direct thermal contact therewith, a heat sink containing a liquid, fire-extinguishing medium, and means inclduing a heat pump operatively connected to said hollow, load-bearing frame structure for circulating the fire-extinguishing, liquid heat transfer medium through the interior of the hollow, load-bearing frame structure so as to extract heat from said panels and to transfer said heat to said heat sink, the hollow, load-bearing frame structure being supported by upright support means and is spaced from a ground surface from which said upright support means extends, the hollow, load-bearing frame structure extending laterally of the upright support means, the upright support means comprising said heat sink.

3. In the structure as claimed in claim 1, wherein the hollow, load-bearing frame structure is a regular polygon in plan and comprises a plurality of side wall members.

4. In the structure as claimed in claim 2, wherein the upright support means comprises a member of tubular form centrally-disposed relative to said frame structure.

5. In a structure as claimed in claim 2, wherein the hollow, load-bearing frame structure includes a tubular member extending upwardly to an upper region of the frame structure and supports a roof structure, said tubular member being located substantially centrally of said frame structure, said roof structure comprising hollow members communicating with said tubular member and extending in cantilevered relation from said tubular member.

6. In a structure as claimed in claim 5, wherein the hollow roof structure members comprises roof beams of metal, and exterior roof panels secured in thermal contact to the roof beams.

7. In a structure as claimed in claim 2, wherein the hollow, load-bearing frame structure comprises vertically-extending, spaced wall supports of metal, said panels are secured in thermal contact between spaced pairs of said hollow, vertically-extending supports.

8. In a structure as claimed in claim 1 including a heat exchanger operatively-disposed in said heat sink, and a liquid-circulating system including temperature conditioning means operatively connected to said heat exchanger for conditioning the temperature within said building frame structure.

9. In a structure as claim in claim 1 wherein the heat sink is divided internally into two separate chambers, each containing a portion of the liquid, fire-extinguishing medium, means for drawing the liquid medium from one chamber, circulating it through said frame structure and returning it to said one chamber, and means for drawing said liquid medium from the other chamber, and heat exchangers within said frame structure for receiving the liquid medium from said other chamber whereby the temperature within the frame structure is conditioned.

10. The structure as claimed in claim 9 wherein said heat sink comprises an upright structure disposed within said frame structure, said separate chambers comprising upper and lower chambers defined within said upright structure.

11. The structure as Claimed in claim 9 including back-up heater means connected to said heat sink for heating the liquid medium therein.

* * * * *